US005569326A

United States Patent [19]

Ruhl

[11] Patent Number: 5,569,326

[45] Date of Patent: Oct. 29, 1996

[54] DEVICE FOR APPLYING AND DOSING LIQUID OR PASTY MATERIALS

[75] Inventor: Friedhelm Ruhl, Steinheim, Germany

[73] Assignee: J. M. Voith GmbH, Heidenheim, Germany

[21] Appl. No.: 390,822

[22] Filed: Feb. 16, 1995

Related U.S. Application Data

[63] Continuation of Ser. No. 6,381, Jan. 19, 1993, abandoned.

[30] Foreign Application Priority Data

Jan. 17, 1992 [DE] Germany ..... 42 01 057.8

[51] Int. Cl.[6] ..... B05C 1/08

[52] U.S. Cl. ..... 118/205; 118/216; 118/244; 118/258; 118/DIG. 10

[58] Field of Search ..... 118/205, 216, 118/244, 258, DIG. 15, 110; 101/375; 100/168, 169, 170; 156/578, 548; 492/4; 427/428

[56] References Cited

U.S. PATENT DOCUMENTS

| | | | |
|---|---|---|---|
| 2,704,392 | 3/1955 | Schultz | 492/4 |
| 3,166,013 | 1/1965 | Wyllie et al. | 492/4 |
| 3,543,366 | 12/1970 | Collet | 492/4 |
| 4,327,467 | 5/1982 | Quaint | 492/4 |
| 4,455,727 | 6/1984 | Tschirnes | 492/4 |

FOREIGN PATENT DOCUMENTS

| | | | |
|---|---|---|---|
| 1131176 | 6/1962 | Germany | 492/4 |
| 9014379 U | 1/1991 | Germany . | |
| 264678 | 1/1927 | United Kingdom | 492/4 |

*Primary Examiner*—Donald E. Czaja
*Assistant Examiner*—Calvin Padgett
*Attorney, Agent, or Firm*—Marshall, O'Toole, Gerstein, Murray & Borun

[57] ABSTRACT

A device for applying and dosing liquid or pasty materials onto moving surfaces, especially onto paper or cardboard webs, is provided. The invention is characterized by a roll, optionally with an outer shell, the diameter of which can be controlled by the application of energy and, under predetermined or desired controllable conditions provides local variations in diameter along the length of the roll or roll shell as a function of time and/or space.

14 Claims, 2 Drawing Sheets

FIG. 1 a
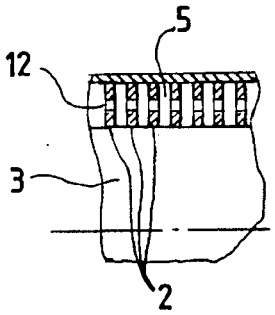
FIG. 1 b
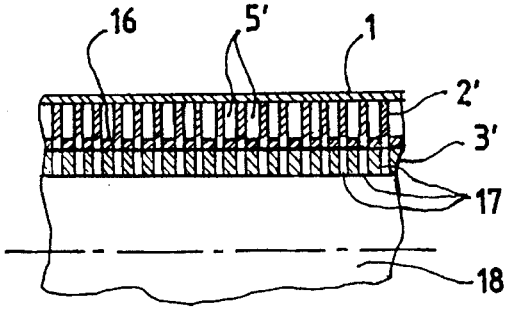
FIG. 2
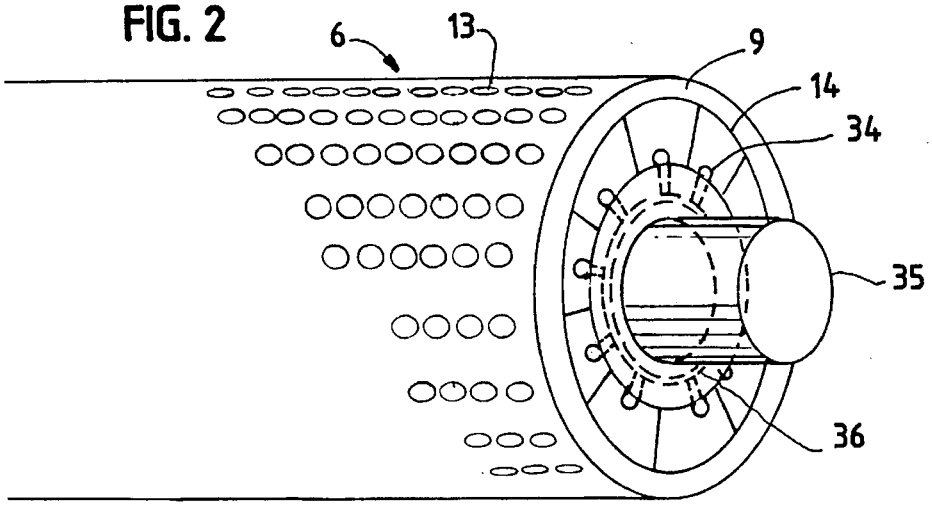
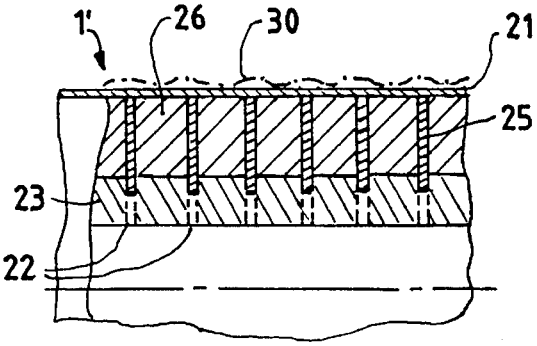
FIG. 3
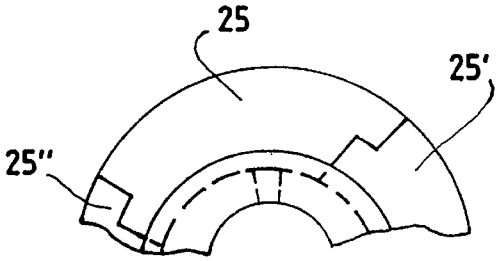
FIG. 4

DEVICE FOR APPLYING AND DOSING LIQUID OR PASTY MATERIALS

CROSS-REFERENCE TO RELATED APPLICATION

This is a continuation of U.S. application Ser. No. 08/006,381 filed Jan. 19, 1993, now abandoned.

BACKGROUND OF THE INVENTION

1. Field of the Invention

The invention is concerned with a device for applying and dosing liquid or pasty substances onto moving surfaces, such as paper or cardboard webs, for example. Preferably, the inventive device takes the form of an application or dosage roll.

2. Background Technology

The amount of pasty substance applied to a moving web from an application or dosing roll can generally be controlled by the following measures:

a) by changing the gap between two cooperating rolls;

b) by having a difference between the velocities of two cooperating rolls; and/or c) with the aid of a blade pressed on the roll with variable force.

Volumetric control of the amount of substance applied is not possible. This means that, by having an appropriate gap width, for example, between two cooperating rolls, the amount applied is controlled by the cross-section of the particular gap section.

Other application methods involve rolls with small surface cups from which excess substance is scraped off to a predetermined height, as well as a pair of rolls, of which one has a desired surface profile. In this case, the gap between the rolls can be adjusted. However, in order to obtain variable volumetric control of the amount applied, it is necessary to change rolls which, of course, involves interruption of production.

SUMMARY OF THE INVENTION

It is an object of the invention to overcome one or more of the problems described above.

According to the invention, control of a variable amount of a substance applied from an applicator roll onto a web guided under tension over a dosage roll is provided. The invention is directed to an application device in which an applicator roll cooperates with a counter roll, with the formation of an application gap, in order to make a desired amount of coating material available for another applicator roll or for direct application from the counter roll onto a paper or cardboard web guided over it.

Further objects and advantages of the invention will be apparent to those skilled in the art from the following detailed description, taken in conjunction with the drawings and the appended claims.

BRIEF DESCRIPTION OF THE DRAWINGS

The invention will be explained below with the aid of the embodiments shown in the drawing. The following are shown:

FIGS. 1*a* and 1*b* are axial sections through first and second embodiments of a roll of the invention, illustrating the principle of operation thereof;

FIG. 2 is a perspective view of a third embodiment of a roll of the invention;

FIGS. 3 and 4 are an axial cross-section and a partial front view, respectively, of a fourth embodiment of the roll of the invention.

DETAILED DESCRIPTION OF THE INVENTION

Figure 5:
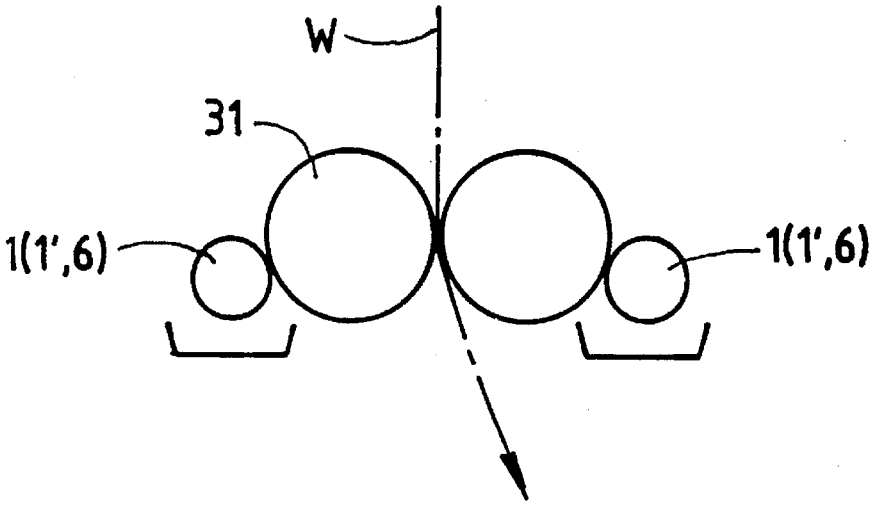
FIGS. 5 to 7 are schematic representations illustrating specific applications of the roll of the invention.

The application and dosage device of the invention comprises a roll, optionally with an external shell, having a diameter which can be varied by the application of energy and which, under predetermined controllable conditions, has a variable thickness along the length of the roll (or external shell) as a function of space and/or time.

Fundamentally, according to the invention, the amount of a substance available can be adapted to the requirements of the particular operation; this can depend on the type of material applied (i.e., the coating material), on the rate of application (i.e., the velocity of the paper or cardboard web), on the amount needed to be applied, on the absorbency of the substrate (paper or cardboard, for example), etc.

FIG. 1*a* illustrates a rotatable and readily deformable roll shell 1, preferably formed of rubber or a similar highly elastic synthetic material, inside of which is disposed a substantially cylindrical support 3, formed of steel, for example, and which preferably also rotates, either in the same direction as the roll shell 1 or in the opposite direction. The space between the support 3 and the roll shell 1 is subdivided into individual chambers 5 by a plurality of ring lands 2. An excess pressure or, preferably, reduced pressure can be applied to the chambers 5 with the aid of a working fluid (for example, a hydraulic fluid or preferably a gas, such as air). For this purpose, the ring lands 2 each have one or, preferably, several throughbores 12. The roll shell 1 is deformed in the region between the ring lands 2 upon the application of reduced or excess pressure, such that the roll shell 1 will assume a wavy surface, as indicated in FIG. 3 by the dotted line curve 30. Naturally, the roll shell 1 must remain tightly fixed against the ring lands 2 during operation, so the roll shell 1 is preferably shrink-fitted onto the lands 2.

The degree of waviness (i.e., the amplitude and wavelength) of the shell 1 can be increased or decreased by the magnitude of reduced or excess pressure, with a wavelength preferably between 0.3 and 1 mm. Of course, the spacing between the ring lands 2 must be correspondingly small.

A similar embodiment is shown in FIG. 1*b*, in which the introduction of the working fluid is done through a hollow cylindrical support 3' with radial throughbores 17. Spacer rings 16 are provided for individual ring lands 2' in order to form individual pressure chambers 5'. Working fluid is introduced through a central pressure chamber 18 with a hollow cylindrical support 3'. The individual ring lands 2' are tensioned against one another in practice with the aid of the spacers 16, and their spacing is thus accurately established. Naturally, the ring lands 2' must also have throughbores which must be at least partially contiguous with the throughbores 17 of the cylindrical support 3'. In this case, it is possible to produce axially varying local pressures in sections by pressure chambers assigned to the various axial sections of the support 3', and thus locally variable waviness can be produced in the roll shell 1.

FIG. 3 shows a variation of a roll 1' in which individual annular pressure stamps 25 are provided in opposed axial spacing with relation to a hollow cylindrical support 23. The pressure stamps each comprise individual ring segments 25, 25', 25", etc., as shown in FIG. 4. Ring wheels 26, onto which a deformable roll shell 21 is pressed, are disposed between the pressure stamps 25. By introducing a working medium through radial bores 22 in the support 23 to the inside of the stamps (rings) 25, at these points the diameter of the roll shell 21 will increase so that the wariness shown by the dotted line 30 will be achieved.

In FIG. 2, individual surface elements 13 protrude from and are guided by the radial outside surface of a roll shell 9. The elements 13 comprise piezoelements, the lengths of which are variable whereby their radial outer, free end surfaces define a wrapper cylinder which has a variable diameter. The piezoelements 13 are disposed in individual cylinder segments 14 which have assorted electrical wires 36 loading to a source of electricity.

Naturally, the radially outer (front) surfaces of the stamp lie on an (imaginary) wrapper cylinder which can also comprise a flexible shell of, for example, rubber.

This variability of the surface of the roll 6 depends on the inverse piezoelectric effect, so that upon application of an electrical field parallel to the direction of polarization of the piezoelectric crystal of the elements 13, expansion of the element 13 in the same direction is obtained. The component with the piezoelectric (inverse) effect is also called a piezoelectric translator (or briefly, piezotranslator).

Naturally, by the application of external magnetic electrical fields, the length of small stamps made of the appropriate materials can be influenced.

Thus, a roll with an irregular surface is obtained, whereby depressions exist between the individual stamps and the coating material which is introduced into these depressions.

The situation is similar to that of the wavy surface of the roll shell 1 or 21 of FIGS. 1 and 3, respectively, in which the coating material is taken up in the valleys of the waves. This form of ductor or dosage element is known in the art as wire-wound cylindrical rods or rolls. Such dosage rods are also obtained by incorporation of grooves into a rod or cylinder. In the case of the devices known in the art, these grooves are very fine and have a cross-section between 0.001 and 0.40 $mm^2$. Correspondingly structured heat fields or electromagnetic radiation can also produce a corresponding waviness on a mantle surface when the material is chosen appropriately.

Figure 6:
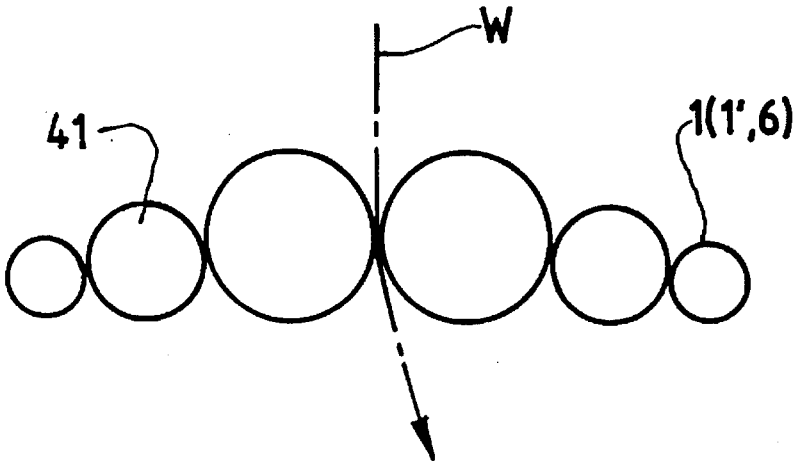
Figure 7:
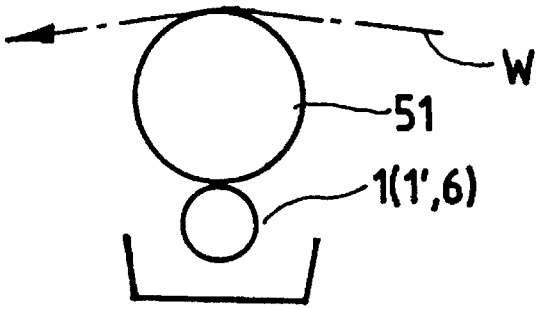

FIGS. 5 to 7 show individual coating devices, in which paper webs W are coated with pasty or liquid compositions. A transfer gap between a roll 1 (alternatively 1' or 6) of the invention and a counter roll 31, 41 or 51, is always formed. In FIG. 5, the respective directions of rotation of the two rolls 1 (1', 6) and 31 can be the same or opposed. In FIG. 6 the directions of rotation of the rolls 1 (1', 6) and 41 can be opposed. In FIG. 7 the rotation directions of the rolls 1 (1', 6) and 51 are the same.

The foregoing detailed description is given for clearness of understanding only, and no unnecessary limitations should be understood therefrom, as modifications within the scope of the invention will be apparent to those skilled in the art.

I claim:

1. A device for applying and dosing liquid or pasty materials onto moving surfaces, comprising a roll having a roll shell which cooperates with a rigid support member and which includes an outer surface and a diameter which is capable of being locally varied along the length of the roll by the application of energy so that the roll shell may assume a wavy outer surface comprising a multiplicity of hills and valleys during application of energy while remaining in contact with said support member at each of one of said hills or valleys, in response to predetermined controllable conditions.

2. The device of claim 1 further including means for applying energy and wherein said roll surface of said roll shell has an outer diameter which is variable as a function of the applied energy.

3. The device of claim 2 wherein individual surface elements which protrude from and are guided by the radially outer surface of the roll shell are provided and comprise piezoelements, the lengths of which can be varied, whereby the radially outer free end surfaces thereof define a wrapper cylinder, the diameter of which can be varied by varying the lengths of the piezoelements.

4. The device of claim 3 wherein the piezoelements are disposed in individual cylinder segments associated with electrical wires for the piezoelements.

5. The device of claim 4 wherein the cylinder segments are supported on the outer surface of the roll shell.

6. The device of claim 1 wherein pressure stamps in the form of annular walls are disposed axially in sections along an outer roll shell on a central support device for pressing out the roll shell at defined points, said annular walls being spaced equal distances from one another.

7. The device of claim 6 wherein the annular walls comprise ring sector-shaped elements.

8. The device of claim 6 wherein the annular walls comprise an expandable synthetic material or a synthetic material composite structure.

9. The device of claim 1 wherein said rigid support member comprises a plurality of lands and further including a radially inner support, wherein said outer roll shell is formed of a readily deformable elastic material surrounding and supported thereon, said inner support and said shell defining a space therebetween subdivided by said lands into individual chambers, said lands supporting the roll shell with a source of reduced pressure or excess pressure of controllable intensity adapted to be connected to the chambers for adjustment of pressure in the chambers in order to produce a desired local variation in the diameter of the roll shell.

10. The device of any one of claims 1 and 3–8 wherein the roll is adapted to be associated with a counter roll in order to transfer coating material in a gap defined between the two rolls onto the counter roll at a desired rate.

11. A device for applying and dosing liquid or pasty materials onto moving surfaces comprising:

a deformable roll shell having an outer surface adapted to be varied in shape by the application of energy;

a roll support, disposed within said roll shell, with an interior space defined between said roll support and said roll shell;

at least three ring lands disposed in said interior space, said ring lands contacting and cooperating with said roll shell and cooperating with said roll support to form a plurality of individual chambers in said interior space, said chambers being adapted to vary in size by receiving a supply of fluid, so that said roll shell remains in contact with said ring lands upon the application of energy and will assume a wavy surface comprising a multiplicity of hills and valleys during use, with said valleys adapted for taking up said liquid or pasty material.

12. The device of claim 1 wherein said roll shell is tightly fixed against said rigid support member.

13. The device of claim 11 wherein said roll shell is tightly fixed against said ring lands.

14. The device of claim 2 wherein said roll surface of said roll shell assumes a wavy outer surface comprising a multiplicity of hills and valleys with wavelengths between approximately 0.3 and 1.0 millimeters during application of the applied energy.

* * * * *